US011174663B2

(12) United States Patent
Gerber

(10) Patent No.: US 11,174,663 B2
(45) Date of Patent: Nov. 16, 2021

(54) EXTERIOR DOOR HANDLE ARRANGEMENT FOR A MOTOR VEHICLE

(71) Applicant: Dr. Ing. h.c. F. Porsche Aktiengesellschaft, Stuttgart (DE)

(72) Inventor: Harald Gerber, Walheim (DE)

(73) Assignee: Dr. Ing. h.c. F. Porsche Aktiengesellschaft

( * ) Notice: Subject to any disclaimer, the term of this patent is extended or adjusted under 35 U.S.C. 154(b) by 561 days.

(21) Appl. No.: 16/166,261

(22) Filed: Oct. 22, 2018

(65) Prior Publication Data

US 2019/0119958 A1 Apr. 25, 2019

(30) Foreign Application Priority Data

Oct. 20, 2017 (DE) ..... 10 2017 124 568.5

(51) Int. Cl.
*E05B 81/90* (2014.01)
*E05B 79/20* (2014.01)
(Continued)

(52) U.S. Cl.
CPC ..... *E05B 81/90* (2013.01); *E05B 79/20* (2013.01); *E05B 81/76* (2013.01); *E05B 81/77* (2013.01);
(Continued)

(58) Field of Classification Search
CPC ..... E05B 81/90; E05B 79/20; E05B 81/76; E05B 85/06; E05B 85/16; E05B 13/001; E05B 13/106; E05Y 2900/531
See application file for complete search history.

(56) References Cited

U.S. PATENT DOCUMENTS 6,240,755 B1 * 6/2001 Da Silva ..... E05B 17/186 292/336.3
8,146,393 B2 * 4/2012 Katagiri ..... E05B 85/18 70/208
(Continued)

FOREIGN PATENT DOCUMENTS

DE 10 2012 102 485 9/2013
DE 102014112887 A1 * 3/2016 ..... E05B 79/20
(Continued)

OTHER PUBLICATIONS

French Search Report dated Oct. 9, 2019.

*Primary Examiner* — Christine M Mills
*Assistant Examiner* — Emily G. Brown
(74) *Attorney, Agent, or Firm* — Gerald E. Hespos; Michael J. Porco; Matthew T. Hespos

(57) ABSTRACT

An exterior door handle arrangement (1) for a motor vehicle includes an electric door closing apparatus (2) accommodated in a vehicle door that includes door handle (10) with a fixed gripping handle (4) and a handle bezel (5). The handle bezel (5) covers the gripping handle (4) and a lock barrel (6) and releases at least the lock barrel (6) in an emergency. An emergency unlocking device has a pull device (13) to actuate an emergency opening mechanism. The handle bezel (5) is mounted pivotably to the gripping handle (4). The handle bezel (5) is locked on the gripping handle (4) in a closed position and is released in an emergency unlocking position to pivot relative to the gripping handle (4). Pulling on the handle bezel (5) actuates the pull device (13) for mechanical actuation of the emergency opening mechanism of the vehicle door.

8 Claims, 4 Drawing Sheets

(51) Int. Cl.
*E05B 85/06* (2014.01)
*E05B 85/16* (2014.01)
*E05B 85/10* (2014.01)
*E05B 81/76* (2014.01)

(52) U.S. Cl.
CPC ..... *E05B 85/06* (2013.01); *E05B 85/10* (2013.01); *E05B 85/16* (2013.01); *E05Y 2900/531* (2013.01)

(56) References Cited

U.S. PATENT DOCUMENTS 10,006,229 B2 * 6/2018 Beck ..... E05B 81/78
2003/0019261 A1 * 1/2003 Wittwer ..... E05B 81/76 70/257
2013/0170241 A1 * 7/2013 Lesueur ..... E05B 83/36 362/501
2014/0230329 A1 * 8/2014 Patel ..... E05B 17/10 49/25
2016/0138303 A1 5/2016 Beck et al.
2016/0145910 A1 * 5/2016 Beck ..... B60J 5/04 70/455
2016/0305164 A1 10/2016 Bendel
2017/0002589 A1 * 1/2017 Toyama ..... E05B 85/16
2017/0260780 A1 * 9/2017 Christensen ..... E05B 81/77

FOREIGN PATENT DOCUMENTS

EP 2642049 A2 * 9/2013 ..... E05B 17/18
WO 2015/062586 5/2015

* cited by examiner

EXTERIOR DOOR HANDLE ARRANGEMENT FOR A MOTOR VEHICLE

CROSS REFERENCE TO RELATED APPLICATION

This application claims priority under 35 USC 119 to German Patent Appl. No. 10 2017 124 568.5 filed on Oct. 20, 2017, the entire disclosure of which is incorporated herein by reference.

BACKGROUND

Field of the Invention

The invention relates to an exterior door handle arrangement for a motor vehicle, comprising an electric door closing apparatus that is accommodated in a vehicle door and has a lock barrel, a door handle with a fixed gripping handle and a cover. The cover is configured to cover at least part of the gripping handle and the lock barrel and releases at least the lock barrel in the case of emergency unlocking of the vehicle door. An emergency unlocking device with a pulling means actuates an emergency opening mechanism to bring about emergency unlocking of the vehicle door.

Related Art

Exterior door handle arrangements for motor vehicles are known in the prior art and enable a vehicle door to be opened or closed by a user. Motor vehicles frequently are equipped with a keyless access system to unlock or relock the vehicle door without the direct use of a vehicle key. Emergency unlocking of the vehicle door can be performed, for example, in the case of a defect of a sensor arrangement that detects an actuating intention of a user, a failure of the on-board electronics, or an accident. Known exterior door handle arrangements have an emergency unlocking device that permits mechanical emergency unlocking of an emergency opening mechanism of the vehicle door.

WO 2015/062586 A1 discloses an exterior door handle arrangement of a motor vehicle having an emergency unlocking device that is covered by a cover and projects in the case of an activation, with the result that it can be actuated by a user.

EP 3 020 895 A1 discloses an exterior door handle arrangement having a fixed door handle. A lock barrel is arranged within the door handle and is covered by a cover in normal operation. The cover can be transferred into an open position, in which the lock barrel is accessible from outside. Furthermore, the exterior door handle arrangement has an emergency unlocking device with a pulling means that is connected to a closing mechanism of the vehicle door and makes mechanical emergency unlocking of the vehicle door possible. Accessibility of the pulling means is improved by connecting the pulling means operatively and mechanically to the cover. The pulling means is pulled slightly out of the door handle when opening the cover and therefore can be reached more simply by a user. Furthermore, the pulling means forms a captive securing means for the covering element.

A disadvantage of the known exterior door handle arrangements is that the handling of the emergency unlocking device is relatively awkward, since a user must manually actuate the emergency unlocking device.

It is an object of the invention to provide an exterior door handle arrangement with simpler handling of the emergency unlocking device.

SUMMARY

An exterior door handle arrangement according to the invention has a cover configured as a handle bezel that is mounted pivotably relative to the gripping handle. The handle bezel is locked on the gripping handle in a closed position and is released from the gripping handle in an emergency unlocking position so that the handle bezel can be pivoted relative to the gripping handle. The handle bezel is configured so that, by pulling on the handle bezel, the pulling means can be actuated for the mechanical actuation of the emergency opening mechanism of the vehicle door. The exterior door handle arrangement of the invention has the advantage that it can be operated very simply and intuitively in the case of emergency unlocking, since the user need not directly actuate the pulling means of the emergency unlocking device. The pulling means may be a Bowden cable and actuation takes place by exerting a pulling force on the handle bezel in its emergency unlocking position. The pulling movement is transmitted to the pulling means of the emergency unlocking device to bring about the emergency unlocking of the vehicle door. In this way, the handling of the emergency unlocking device can be simplified substantially in comparison with the prior art.

The actuating mechanism for the pulling means of the emergency unlocking device may be rendered more mechanically robust and reliable by a deflecting means, such as a pivotably mounted deflecting lever. The deflecting means may be connected to the pulling means and may be configured and arranged to interact with the handle bezel and to actuate the pulling means during the pulling of the handle bezel. The pivotable handle bezel therefore does not interact with the pulling means directly, but rather indirectly via the deflecting lever or other such deflecting means to actuate the pulling means for mechanical emergency unlocking of the vehicle door.

The handle bezel may comprise an actuating means at a first end, at which it is mounted pivotably. The actuating means may be configured for actuating the deflecting means, such as the deflecting lever. An arrangement of the actuating means at the first end of the handle bezel provides kinematic advantages, since the actuating means acts on the pulling means at the beginning of the pivoting movement that is introduced by pulling on the handle bezel.

The handle bezel can have a handle bracket, and the actuating means can be arranged on the handle bracket to further improve the kinematics.

The actuating means may comprise an actuating cam that is integral with the handle bracket to provide a particularly robust mechanical configuration.

The exterior door handle arrangement may have a bearing bracket arranged on the door closing apparatus, and the gripping handle may be fastened to the bearing bracket to obtain secure retention of the door handle on the vehicle door. The deflecting means can be mounted pivotably on the bearing bracket.

The gripping handle may have an access opening for the lock barrel. The access opening may be covered completely by the handle bezel in the closed position of the handle bezel. In this way, the lock barrel can be protected against environmental influences and is accessible only when the handle bezel is situated in its emergency unlocking position.

In the emergency unlocking position of the handle bezel, an emergency key can be inserted into the lock barrel to lock or unlock the vehicle door.

Simple and intuitive unlocking of the vehicle door can be achieved by a button field or a sensor surface on an inner side of the gripping handle and may be configured to generate an electric switching operation for unlocking the door closing apparatus in response to an approach and/or a contact by a hand of a user.

The exterior door handle arrangement may comprise a locking means configured for locking or latching the handle bezel to the gripping handle in a closed position. The locking means for locking the handle bezel on the gripping handle can be provided in a rear region of the handle bezel, and specifically a rear region faces that away from the pivot axis, to make locking of the handle bezel on the gripping handle possible by way of latching. Unlocking of the handle bezel can take place by means of a mechanical button that interacts with the locking means and unlocks the handle bezel by manual actuation. Thus, the handle bezel is lifted up from the gripping handle and is situated in an emergency unlocking position. Manual pulling on the handle bezel from the emergency unlocking position brings about mechanical emergency unlocking of the vehicle door, with the result that the door can be opened.

Further features and advantages of the invention will become clear using the following description of one preferred exemplary embodiment with reference to the appended drawings.

DETAILED DESCRIPTION

Figure 1:
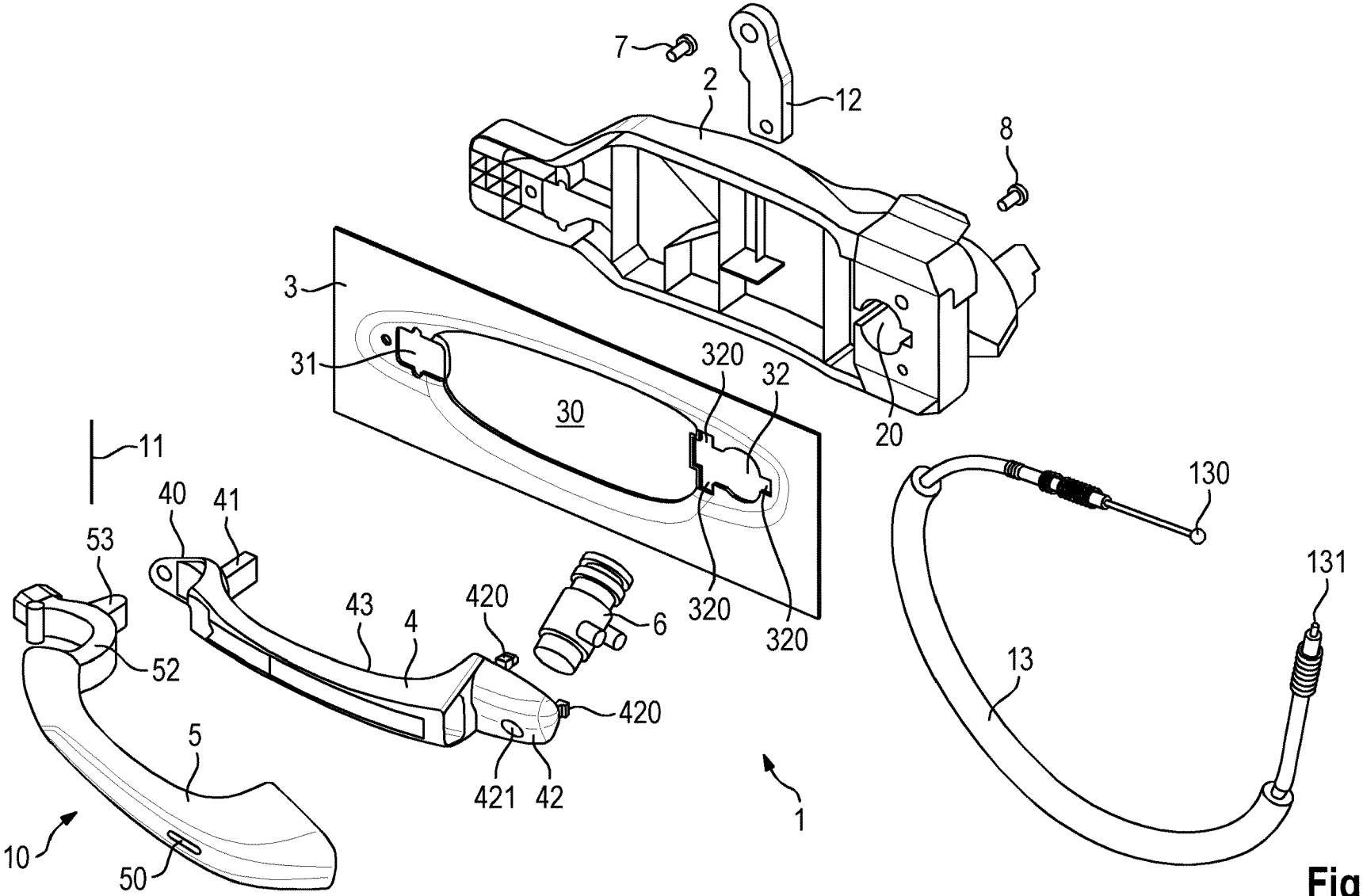
FIG. 1 is an exploded view of an exterior door handle arrangement for a motor vehicle in accordance with one embodiment of the invention.
Figure 2:
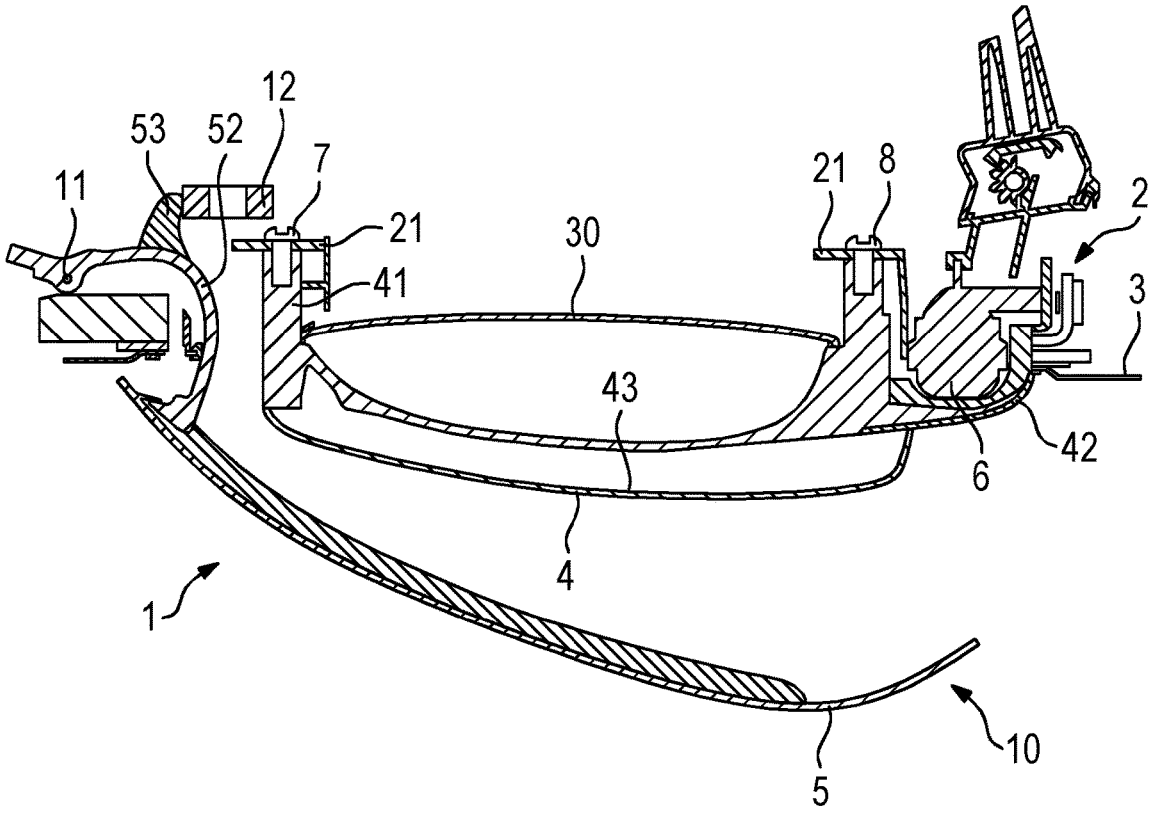
FIG. 2 is a horizontal section through the exterior door handle arrangement of FIG. 1.

With reference to FIGS. 1 and 2, an exterior door handle arrangement 1 for a motor vehicle comprises an electric door closing apparatus 2 having a lock barrel 6 that is mounted fixedly in a correspondingly shaped receiving region of a vehicle door. On a visible side, the electric door closing apparatus 2 is covered by an exterior door panel 3 of the vehicle door. Furthermore, the exterior door handle arrangement 1 has a two-piece door handle 10 comprised of a fixed gripping handle 4 and a handle bezel 5 that can be pivoted out relative to the gripping handle 4. The exterior door handle arrangement 1 is configured to permit emergency unlocking of the vehicle door.

A recessed grip 30 is formed in the exterior door panel 3 to facilitate the gripping of the fixed gripping handle 4 during opening or closing of the vehicle door. A front end of the recessed grip 30 is adjoined by a first cutout 31 of the exterior door panel 3. A second cutout 32 of the exterior door panel 3 adjoins a rear end of the recessed grip 30. The second cutout 32 is shaped so that the lock barrel 6 can be guided through the second cutout 32 during assembly and, in the process, can be fixed in a lock barrel receptacle 20 of the electric door closing apparatus 2.

In a front region, the gripping handle 4 has a first holding section 40 with a projection 41 that is guided through the first cutout 31 of the exterior door panel 3 during the assembly of the gripping handle 4. In a rear region, the gripping handle 4 has a second holding section 42 that comprises three latching projections 420, of which only two can be seen in FIG. 1. The second cutout 32 has three latching recesses 320, into which the latching projections 420 of the second holding section 42 of the gripping handle 4 can engage in a latching manner during the assembly to bring about prefixing of the exterior door handle 4 on the exterior door panel 3. As can be seen in FIG. 2, the closing apparatus 2 has a bearing bracket 21 on a rear side that faces away from the exterior door panel 3, and the gripping handle 4 is fixed on the bearing bracket 21 by two fastening screws 7, 8.

To unlock the vehicle door, a button field BF is provided on an inner side 43 of the gripping handle 4 and is connected to the electric door closing apparatus 2. As an alternative, a sensor surface that is connected to the electric door closing apparatus 2 can also be on the inner side 43 of the gripping handle 4 for this purpose. An electric switching operation is initiated by an interaction of the hand of a user with the button field or with the sensor field, in particular by way of an approach and/or contact. The electric switching operation causes the electric door closing apparatus 2 to unlock the vehicle door. The vehicle door can then be opened by subsequently pulling on the door handle 10. The opening of the vehicle door in the above-described way is possible only if a user carries a corresponding access authorization device with himself/herself, such as an identification device that can be a radio remote control or a radio key. Together with the electric door closing apparatus 2, the access authorization device forms at least one part of a security system of the motor vehicle to prevent opening of the vehicle door by unauthorized persons.

A capacitive sensor means 50 is provided on an outer side of the handle bezel 5 and is connected to the electric door closing apparatus 2. An approach and/or contact by the hand of a user initiates an electric switching operation in the case of a closed vehicle door so that the electric door closing apparatus 2 locks the vehicle door. It is likewise necessary for the access authorization device to be carried for the locking operation to check the access authorization of the user. Remote locking of the vehicle door can take place if the access authorization device is, for example, a radio remote control or a radio key.

The access authorization device, the electric door closing apparatus 2 or the on-board electronics of the motor vehicle might not function properly. In this situation, an emergency unlocking of the vehicle door is carried out by an emergency unlocking device. An emergency key can be inserted into the lock barrel 6 that is arranged within the closing device 2 to make locking or unlocking of the vehicle door possible. An access to the lock barrel 6 is made possible by an access opening 421 within the second holding section 42 of the gripping handle 4.

Figure 3:
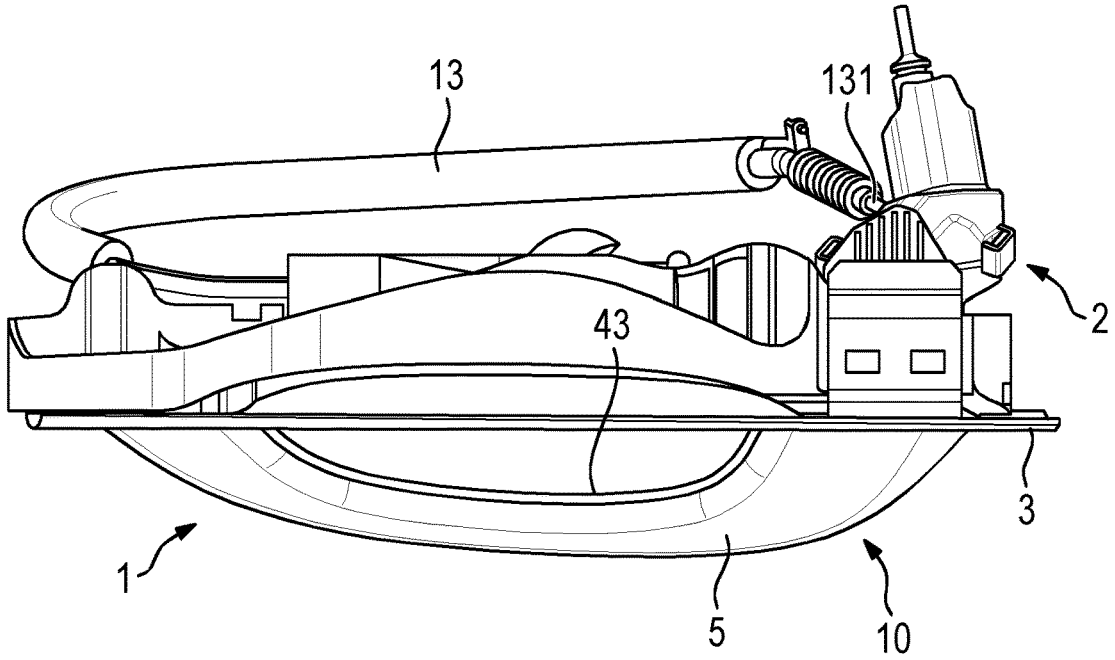
FIG. 3 is a plan view of the exterior door handle arrangement in a closed position of a handle bezel.
Figure 5:
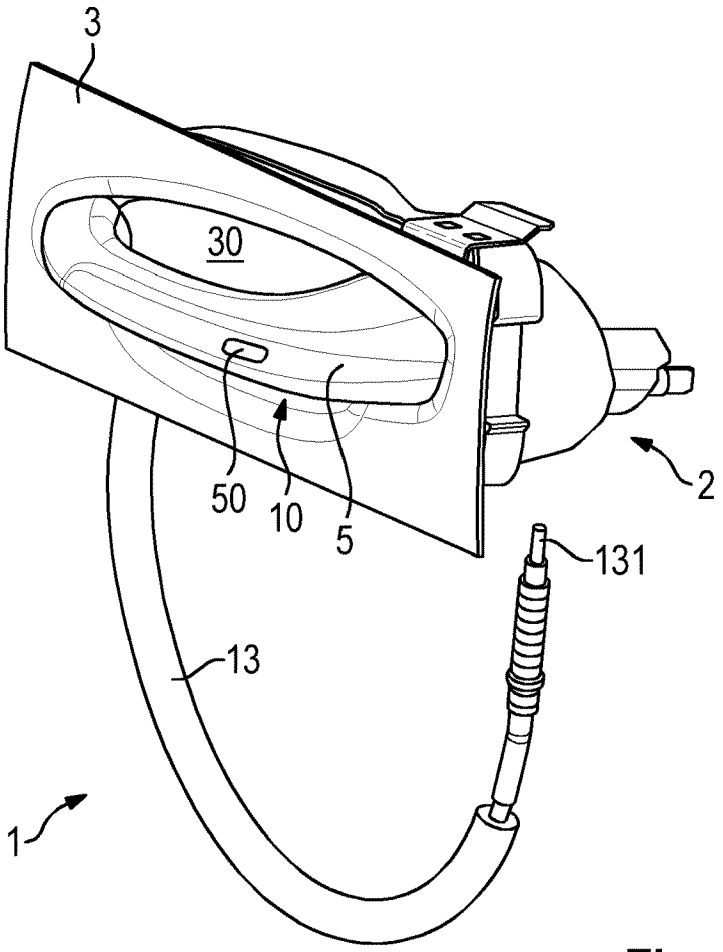
FIG. 5 is a perspective view of the exterior door handle arrangement in the closed position of the handle bezel.

The handle bezel 5 is mounted to be pivoted relative to the gripping handle 4 by means of a bearing axis 11, and is shaped to cover an outer side of the gripping handle 4 completely, as shown in FIGS. 3 and 5. At this time, the second holding section 42 with the access opening 421 for the lock barrel 6 is in a closed position so that the lock barrel 6 is not accessible from the outside. As an alternative, the handle bezel 5 can be shaped to cover the outer side of the gripping handle 4 only partially.

Figure 4:
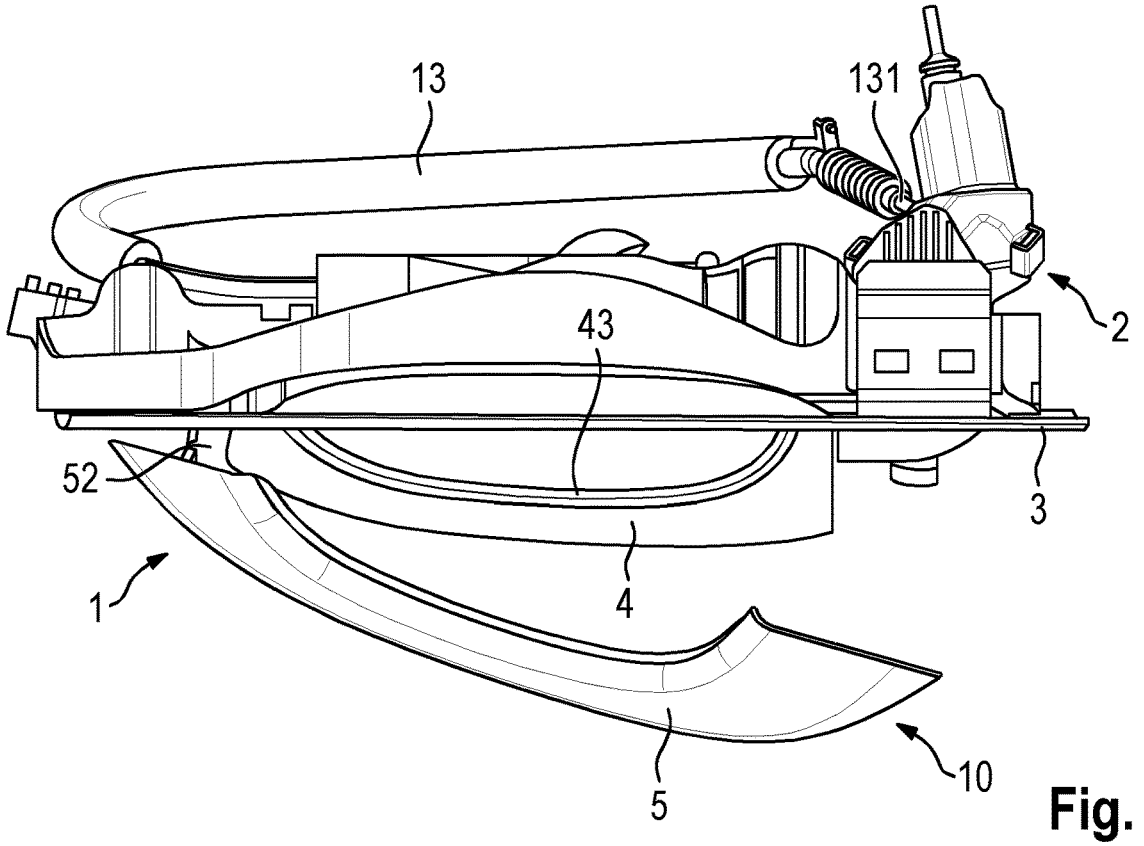
FIG. 4 is a plan view of the exterior door handle arrangement in an emergency unlocking position of the handle bezel.
Figure 6:
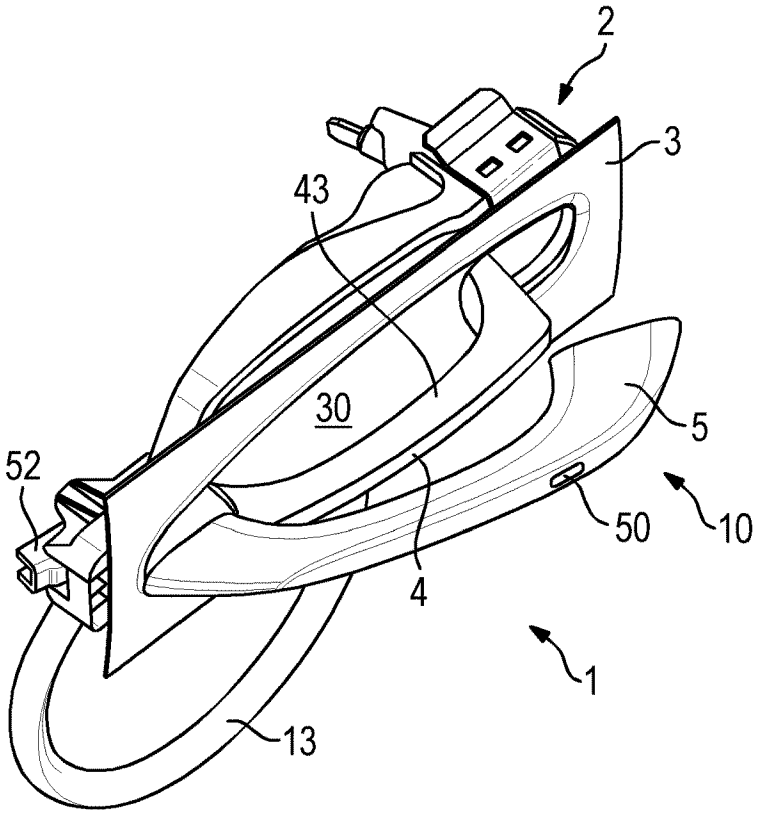
FIG. 6 is a perspective view of the exterior door handle arrangement in the emergency unlocking position of the handle bezel.

The two-piece embodiment of the door handle 10 with the handle bezel 5 that can be pivoted relative to the fixed gripping handle 4 is used for the emergency unlocking of the electric door closing apparatus 2. In the closed position, the handle bezel 5 is latched and connected to the gripping handle 4 and completely or partially covers the gripping handle 4, including the access opening 421, via which the emergency key can be plugged into the lock barrel 6. However, an unlocking device, such as a mechanical button or a latching system, is provided on the handle bezel 5 and is accessible at a rear part of the gripping handle 4. The unlocking device can be brought selectively out of engagement for releasing the handle bezel 5 from the gripping handle 4 and, as a result, the handle bezel 5 can be lifted up from the gripping handle 4 and transferred it into an emergency unlocking position, as shown in FIGS. 2, 4 and 6.

A handle bracket 52 is formed integrally at a front region of the handle bezel 5 and is mounted pivotably by means of the bearing axis 11. The handle bracket 52 includes an actuating cam 53. The emergency unlocking device further comprises a deflecting lever 12 that is mounted pivotably on the bearing bracket 21, and a pulling means 13, which is configured as a Bowden cable in the present case. The pulling means 13 has a first end 130 connected to the deflecting lever 12 and a second end 131 connected to a mechanical emergency opening mechanism of the vehicle door. The pulling means 13 mechanically actuates the emergency opening mechanism of the vehicle door. In the emergency unlocking position of the handle bezel 5, in which the handle bezel 5 is pivoted out in relation to the fixed gripping handle 4, a user can exert a pulling force on the handle bezel 5 to pivot the handle bezel 5 farther toward the outside relative to the gripping handle 4. While the handle bezel 5 is being pulled, the actuating cam 53 interacts with the deflecting lever 12 and actuates the deflecting lever 12. The pulling means 13 is connected to the deflecting lever 12 and actuates the emergency opening mechanism of the vehicle door so that mechanical emergency unlocking of the vehicle door takes place and the vehicle door can be opened.

The pivoting of the handle bezel 5 with respect to the gripping handle 4 provides access to the access opening 421 of the second holding section 420, and thus provides access to the lock barrel 6 from the outside. An emergency key can be inserted into the lock barrel 6 via the access opening 421 so that the vehicle door can be selectively locked or unlocked by actuation of the emergency key.

What is claimed is:

1. An exterior door handle arrangement for a motor vehicle, comprising an electric door closing apparatus that is accommodated in a vehicle door and has a lock barrel, a door handle that has a fixed gripping handle and a handle cover that is configured to at least partially cover the gripping handle and the lock barrel and releases at least the lock barrel in the case of emergency unlocking of the vehicle door, a pulling means connected to the lock barrel to permit emergency unlocking of the vehicle door, and a pivotable deflecting lever connected to the pulling means, the pivotable deflecting lever being configured and arranged to interact with the handle cover, wherein the handle cover is mounted pivotably relative to the gripping handle and is locked on the gripping handle in a closed position, and the handle cover being configured so that a pulling on the handle cover interacts with the pivotable deflecting lever to actuate the pulling means, to release the handle cover from the gripping handle and to enable mechanical actuation of the lock barrel for permitting emergency opening of the vehicle door.

2. The exterior door handle arrangement of claim 1, wherein the handle cover has opposite first and second ends, the first end of the handle cover being mounted pivotably with respect to the fixed gripping handle, the first end of the handle cover including an actuating means that is configured to actuate the deflecting lever.

3. The exterior door handle arrangement of claim 2, wherein the handle cover has a handle bracket on which the actuating means is arranged.

4. The exterior door handle arrangement of claim 3, wherein the actuating means comprises an actuating cam that is integral with the handle bracket.

5. The exterior door handle arrangement of claim 1, further comprising a bearing bracket on the door closing apparatus and to which the gripping handle is fastened.

6. The exterior door handle arrangement of claim 5, wherein the deflecting lever is pivotable relative to the bearing bracket.

7. The exterior door handle arrangement of claim 1, wherein the gripping handle has an access opening for the lock barrel, the access opening being covered completely by the handle cover in the closed position of the handle cover.

8. The exterior door handle arrangement of claim 1, further comprising a button field or a sensor surface on an inner side of the gripping handle for generating an electric switching operation for unlocking the door closing apparatus in response to an approach and/or a contact of a hand of a user.

* * * * *